US009052110B2

(12) United States Patent
Furukawa et al.

(10) Patent No.: US 9,052,110 B2
(45) Date of Patent: Jun. 9, 2015

(54) CONVERTER EXHAUST GAS RECOVERY APPARATUS AND CONVERTER EXHAUST GAS RECOVERY METHOD

(75) Inventors: Naoki Furukawa, Tokyo (JP); Haruo Kohtaki, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 24 days.

(21) Appl. No.: 13/979,161

(22) PCT Filed: May 30, 2012

(86) PCT No.: PCT/JP2012/064006

§ 371 (c)(1),
(2), (4) Date: Jul. 11, 2013

(87) PCT Pub. No.: WO2013/179432

PCT Pub. Date: Dec. 5, 2013

(65) Prior Publication Data

US 2013/0333598 A1 Dec. 19, 2013

(51) Int. Cl.

| | |
|---|---|
| ***G01M 15/10*** | (2006.01) |
| ***F23J 15/02*** | (2006.01) |
| ***F23N 5/00*** | (2006.01) |

(52) U.S. Cl.

CPC ..... *F23J 15/022* (2013.01); *F23N 5/003* (2013.01); *F23N 2900/05001* (2013.01)

(58) Field of Classification Search

CPC .. G01M 15/10; G01M 15/102; G01M 15/104
USPC ..... 73/23.31, 114.69, 114.71, 114.73
See application file for complete search history.

(56) References Cited

U.S. PATENT DOCUMENTS

| | | | | |
|---|---|---|---|---|
| 8,424,292 | B2 * | 4/2013 | Hoyte et al. | 60/286 |
| 8,500,442 | B2 * | 8/2013 | Knittel et al. | 431/76 |
| 2013/0166242 | A1 * | 6/2013 | Ido et al. | 702/104 |

FOREIGN PATENT DOCUMENTS

| | | | |
|---|---|---|---|
| CN | 101476014 | A | 7/2009 |
| CN | 201620173 | U | 11/2010 |
| JP | 5-209212 | A | 8/1993 |
| JP | 2002-277391 | A | 9/2002 |
| JP | 2004-115891 | A | 4/2004 |
| JP | 2004-278869 | A | 10/2004 |
| JP | 2006-125848 | A | 5/2006 |
| JP | 2007-170841 | A | 7/2007 |
| JP | 2011-38877 | A | 2/2011 |
| JP | 2012-102367 | A | 5/2012 |

(Continued)

OTHER PUBLICATIONS

Chinese Office Action and English translation thereof, dated Jul. 2, 2014, for Chinese Application No. 201280007019.8.

Meixia, "Anti-interference Measures and Devices for Laser Analyzer Measurement Optical Path", Jiugang Technology, No. 1, Mar. 31, 2011, pp. 162-166.

Japanese Office Action dated Jan. 7, 2014, issued in Japanese Patent Application No. JP 2010-251939.

"The 3rd Edition Steel Handbook II, Manufacturing of Pig Iron & Steel," Edited by the Iron and Steel Institute of Japan, Maruzen Co., Ltd, Sep. 20, 1980, p. 462.

International Search Report Issued in PCT/JP2012/064006, mailed on Aug. 28, 2012.

* cited by examiner

*Primary Examiner* — Eric S McCall

(74) *Attorney, Agent, or Firm* — Birch, Stewart, Kolasch & Birch, LLP

(57) ABSTRACT

A converter exhaust gas recovery apparatus includes a furnace top oxygen analyzer that analyzes an oxygen concentration in exhaust gas on an exhaust gas path and on an upstream side of a dust collection position where dust collection is performed and a furnace top CO analyzer that analyzes a CO concentration in the exhaust gas; and a furnace bottom oxygen analyzer that irradiates the exhaust gas that flows on a downstream side of the dust collection position with a laser light and analyzes the oxygen concentration based on quantity-of-light changes caused by a light absorption of the laser light.

14 Claims, 4 Drawing Sheets

| PATTERN | TIP SHAPE |
|---|---|
| a | |
| b | |
| c | |
| d | |

| PATTERN | TIP SHAPE |
|---|---|
| a | |
| b | |
| c | |
| d | |

CONVERTER EXHAUST GAS RECOVERY APPARATUS AND CONVERTER EXHAUST GAS RECOVERY METHOD

TECHNICAL FIELD

The present invention relates to a converter exhaust gas recovery apparatus and a converter exhaust gas recovery method that collect dust from exhaust gas generated in a converter and recover combustible gas in a non-combustion state.

BACKGROUND ART

The exhaust gas generated during converter refinement contains carbon monoxide at a high concentration. As apparatuses that process this converter exhaust gas, there are a combustion type exhaust gas processing apparatus that recovers energy in a boiler after carbon monoxide in exhaust gas is combusted at the top of the converter and a non-combustion type exhaust gas processing apparatus that recovers carbon monoxide without combustion. As the non-combustion type exhaust gas processing apparatus, for example, an OG system converter exhaust gas recovery apparatus as described in Non-Patent Document 1 is typically used.

In refinement in a converter, first, the converter is charged with molten iron and decarburization refinement is mainly performed by converter blowing. After the completion of the refinement, molten steel is tapped, slag is removed, and molten iron is charged for the next refinement. In the converter refinement cycle as described above, a large amount of exhaust gas containing a high concentration of carbon monoxide is generated during the converter blowing. Exhaust gas is not generated while blowing is not conducted. Additionally, although the generation amount of the exhaust gas increases rapidly immediately after the start of blowing, a high concentration of oxygen is contained in the exhaust gas immediately after the start of the blowing, and the carbon monoxide concentration is not high. As time passes from the start of the blowing, the oxygen concentration in the exhaust gas drops, and the carbon monoxide concentration increases.

If the exhaust gas is started to recover when the carbon monoxide concentration in the exhaust gas is not high immediately after the start of the blowing, a quality of the recovered exhaust gas as fuel gas decreases. This is not preferable, and therefore, the exhaust gas is usually diffused into the atmosphere at the time of the start of the converter blowing as described in Patent Document 1. Also, a CO-in-gas concentration analyzer (furnace top CO analyzer) is provided on an exhaust gas path of a radiation section at the top of a converter to measure the carbon monoxide concentration in the exhaust gas, and if the carbon monoxide concentration in the exhaust gas rises to more than a given concentration, recovery of the exhaust gas to a gas holder is started.

As described above, the oxygen concentration in the exhaust gas is high immediately after the start of the blowing. Additionally, if damage or the like occurs in the exhaust path and ambient air is mixed into the exhaust gas, the oxygen concentration in the exhaust gas may increase. If the exhaust gas is recovered when the oxygen concentration in the exhaust gas is high, a component in the exhaust gas may exceed an explosion limit. Therefore, an oxygen-in-gas concentration analyzer (furnace top oxygen analyzer) is provided on the exhaust gas path of the radiation section at the top of the converter from a viewpoint of safety, an oxygen-in-gas concentration analyzer (furnace bottom oxygen analyzer) is provided at a flue after wet dust collection, and the exhaust gas is recovered to the gas holder only in a case where both the oxygen concentrations in the exhaust gas at these two places are a given concentration or lower.

At the time of the start of blowing, the exhaust gas from the flue is discharged to a flare stack by the operation of a three-way valve after a recovery valve is closed. After the start of the blowing, when the conditions that the carbon monoxide concentration measured by the furnace top CO analyzer becomes a given concentration or higher, for example, 25% or higher and the oxygen concentrations in the exhaust gas at two places measured by the furnace top oxygen analyzer and the furnace bottom oxygen analyzer become a given concentration or lower, for example, 2% or lower are established, for the first time, the recovery valve is opened, and the exhaust gas path is switched by the operation of the three-way valve to start the recovery of the exhaust gas to the gas holder.

In the oxygen concentration analysis in the converter exhaust gas, a method of sampling and analyzing gas within the flue (exhaust gas path) is generally used. For example, a paramagnetic oxygen analyzer using a wet sampler is used. Gas is sampled from the flue using a water stream, the sampled gas is introduced into the paramagnetic oxygen analyzer via a drain separator, a gas cooler, and a drain separator, and the oxygen concentration in the sampled gas is measured.

In converter gas recovery apparatuses of the related art, response delay of analysis in the furnace bottom oxygen analyzer is present. Therefore, there is a problem in that the timing at which recovery of the exhaust gas to the gas holder is started may be delayed after the start of converter blowing, and the converter exhaust gas that is combustible gas cannot be effectively utilized.

Additionally, as a gas analyzer, a laser type gas analyzer that irradiates measurement gas with laser light and measures the gas concentration from quantity-of-light changes caused by the light absorption of the laser light is disclosed in, for example, Patent Documents 2 and 3.

However, until now, there has been no example where the above laser type gas analyzer is applied to the converter gas recovery apparatus.

CITATION LIST

Patent Document

Patent Document 1: Japanese Unexamined Patent Application, First Publication No. H5-209212

Patent Document 2: Japanese Unexamined Patent Application, First Publication No. 2002-277391

Patent Document 3: Japanese Unexamined Patent Application, First Publication No. 2007-170841

Non-Patent Document

Non-Patent Document 1: Page 462 of "Third Edition, Steel Manual II, Iron Making and Steel Making" published by The Iron and Steel Institute of Japan

SUMMARY OF THE INVENTION

Technical Problem

The present invention has been made based on the above knowledge. That is, the present invention relates to a converter exhaust gas recovery apparatus that collects dust from exhaust gas (converter exhaust gas) generated in a converter and recovers combustible gas in a non-combustion state, and an object thereof is to provide a converter exhaust gas recovery apparatus and a converter exhaust gas recovery method is capable of using a laser type gas analyzer as a furnace bottom oxygen analyzer, reducing the response delay of analysis of oxygen in gas in an exhaust gas path after dust collection and increasing the amount of recovery of the converter exhaust gas.

Solution to Problem

In order to solve the above problems and achieve the relevant object, the present invention has adopted the following measures.

(1) A converter exhaust gas recovery apparatus according to an aspect of the present invention is a converter exhaust gas recovery apparatus that performs a dust collection while causing exhaust gas generated in a converter to flow to an exhaust gas path and recovers combustible gas in a non-combustion state. The apparatus includes a furnace top oxygen analyzer that analyzes an oxygen concentration in the exhaust gas on the exhaust gas path and on an upstream side of a dust collection position where the dust collection is performed, and a furnace top CO analyzer that analyzes a CO concentration in the exhaust gas; and a furnace bottom oxygen analyzer that irradiates the exhaust gas that flows on a downstream side of the dust collection position with laser light and analyzes the oxygen concentration based on quantity-of-light changes caused by a light absorption of the laser light.

(2) In the converter exhaust gas recovery apparatus described in the above (1), the furnace bottom oxygen analyzer may include: a laser irradiation part that radiates the laser light so as to be at a right angle to a centerline of a flow of the exhaust gas; a laser light receiving part that receives the laser light after having passed through the exhaust gas; a first insertion tube that protrudes from the laser irradiation part toward an inside of the exhaust gas path so as to surround the periphery of an optical path of the laser light and is open at a tip thereof; a second insertion tube that protrudes from the laser light receiving part toward the inside of the exhaust gas path so as to surround the periphery of the optical path of the laser light and is open at a tip thereof; and nitrogen gas supply device that supplies nitrogen gas to an inside of the first insertion tube and an inside of the second insertion tube (3) In the converter exhaust gas recovery apparatus described in the above (2), a transmissivity of the laser light, which is represented by a ratio of a light quantity of the laser light, having a wavelength other than an absorption wavelength of oxygen, which is received by the laser light receiving part, to the light quantity of the laser light radiated from the laser irradiation part, may be 10% or higher.

(4) In the converter exhaust gas recovery apparatus described in the above (3), a relationship between an interval between the tip of the first insertion tube and the tip of the second insertion tube and the transmissivity may satisfy a following Expression 1.

$$X=\alpha\times\exp(-L\times\beta\times v)\times 100 \qquad \text{Expression 1}$$

Here, X is the transmissivity as a percentage, L is the interval in units of m, v is a flow velocity of the exhaust gas and in units of m/s, $\alpha$ is a damping coefficient of the laser light, and $\beta$ is a coefficient representing an absorbance of the exhaust gas.

(5) In the converter exhaust gas recovery apparatus described in any one of the above (2) to (4), cutouts may be formed on the downstream sides of both the tip of the first insertion tube and the tip of the second insertion tube in a flow direction of the exhaust gas when viewed by the line of sight perpendicular to a virtual plane including the centerline of the flow of the exhaust gas and an optical axis of the laser light.

(6) In the converter exhaust gas recovery apparatus described in the above (5), when the cutouts are viewed by the line of sight, the cutouts may be formed by inclined surfaces that have an inclination of 45° to 75° with respect to the centerline of the flow of the exhaust gas and a length of the inclined surfaces in a direction along the centerline of the flow of the exhaust gas may be ⅓ to ⅔ of an outside dimension of the insertion tubes.

(7) A converter exhaust gas recovery method according to an aspect of the present invention is a converter exhaust gas recovery method performed using the converter exhaust gas recovery apparatus according to any one of the above (1) to (6). The method includes: diffusing a generated exhaust gas to an atmosphere when converter blowing is started; and recovering the exhaust gas when both an oxygen concentration analyzed by the furnace top oxygen analyzer and an oxygen concentration analyzed by the furnace bottom oxygen analyzer are a predetermined concentration or lower and an CO concentration analyzed by the furnace top CO analyzer is a predetermined concentration or higher.

Advantageous Effects of Invention

By using the converter exhaust gas recovery apparatus or the converter exhaust gas recovery method according to the above aspects of the present invention, the response delay of analysis of oxygen in gas can be reduced and the amount of recovery of the converter exhaust gas can be increased, in the converter exhaust gas recovery for collecting dust from the exhaust gas generated in the converter and recovering combustible gas in a non-combustion state. Additionally, in a case where a laser type gas analyzer having insertion tubes is used, measurement accuracy or workability can be further improved.

DESCRIPTION OF EMBODIMENTS

In the converter exhaust gas recovery apparatus of the related art, the time which is required for converter exhaust gas to pass through the position of a furnace bottom oxygen analyzer after passing through the position of a furnace top oxygen analyzer when converter exhaust gas moves along an exhaust gas path, is about 30 seconds. However, if the time course of the gas concentration analyzed by a gas analyzer is compared from immediately after the start of converter blowing, it was found that about 110 seconds have passed until the oxygen-in-gas concentration analyzed by the furnace bottom oxygen analyzer becomes 2% or lower after the oxygen-in-gas concentration analyzed by the furnace top oxygen analyzer becomes 2% or lower. The response delay of analysis in this furnace bottom oxygen analyzer is thought to be caused by the delay in the analysis until the results of gas analysis are available from the gas is sampled from the exhaust gas path in the oxygen analysis in the furnace bottom oxygen analyzer.

The laser type gas analyzer irradiates measurement gas that flows in a conduit with laser light, detects laser light transmitted through measurement space, and detects gas components. Therefore, application of the laser type gas analyzer to converter gas that contains dust like converter dust or water vapor generated during dust collection and scatters the laser light has not been considered.

The present inventors have revealed that the response delay of the oxygen-in-gas analysis can be reduced by using the laser type gas analyzer as the furnace bottom oxygen analyzer of the converter exhaust gas recovery apparatus as will be described below.

Figure 1:
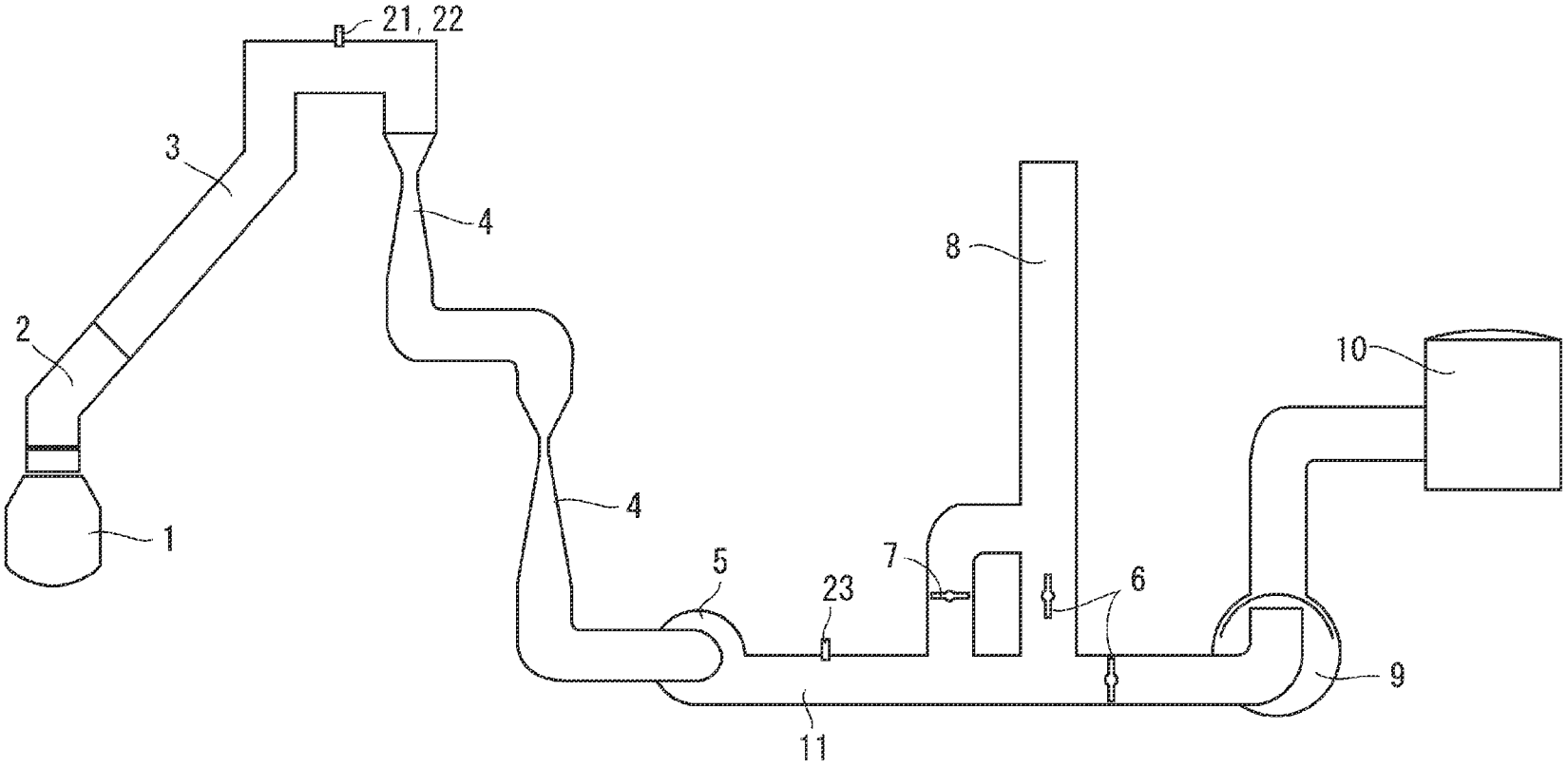
FIG. 1 is a front view showing the overall outline of an OG system converter exhaust gas recovery apparatus.

The converter exhaust gas recovery apparatus and the converter exhaust gas recovery method according to the present embodiment will be described below. The overall OG system converter exhaust gas recovery apparatus adopted in the present embodiment is shown in FIG. 1.

The exhaust gas generated within the converter is collected by the hood 2 arranged at an upper part of the converter 1. The collected exhaust gas is cooled in a radiation section 3 and is then subjected to wet dust collection performed by a two-stage venturi scrubber (dust collection position) 4. The exhaust gas after the wet dust collection is blown by an induced draft fan 5 provided in the path of a flue 11, and reaches a three-way valve 6. One path that branches in the three-way valve 6 leads to a flare stack 8, and the exhaust gas that has flowed through this path is diffused into the atmosphere. Another path that branches in the three-way valve 6 leads to a gas holder 10 via a recovery valve 9. By operating the three-way valve 6, whether the exhaust gas discharged from the converter 1 is guided to the gas holder 10 or diffused from the flare stack 8 can be selected. As described above, the converter gas flows toward the flare stack or the gas holder on the downstream side of the path from the converter on the upstream side of the path. Hereinafter, the path along which the gas flows from the converter to the flare stack or the gas holder is generically referred to as exhaust gas path.

A first oxygen-in-gas concentration analyzer (hereinafter referred to as furnace top oxygen analyzer) 21 and a CO-in-gas concentration analyzer (hereinafter referred to as furnace top CO analyzer) 22 are arranged at the radiation section 3 at the top of the converter, which is the exhaust gas path on the upstream side of the wet dust collection position. Additionally, a second oxygen-in-gas concentration analyzer (hereinafter referred to as furnace bottom oxygen analyzer) 23 is arranged at the flue 11 that is the exhaust gas path on the downstream side of the wet dust collection position. Additionally, the furnace bottom oxygen analyzer 23 is arranged at the flue 11 on the downstream side of the induced draft fan 5.

Whether the converter exhaust gas is recovered in the gas holder 10 or is diffused into the atmosphere via the flare stack 8 is determined depending on the gas analysis results of the exhaust gas. For example, a case of the carbon monoxide concentration in the exhaust gas analyzed by the furnace top CO analyzer 22 being 25% or higher and both the oxygen concentration in the exhaust gas analyzed by the furnace top oxygen analyzer 21 and the furnace bottom oxygen analyzer 23 being 2% or lower is adopted as recovery conditions and if the recovery conditions are established, the exhaust gas is recovered in the gas holder 10. If any one of the conditions are not met, the exhaust gas is diffused from the flare stack 8. In addition, the above recovery conditions are examples and can be appropriately changed depending on the facility.

As described above, since the oxygen concentration in the converter exhaust gas is high at the time of the start of converter blowing and the carbon monoxide concentration is low, the converter exhaust gas is diffused from the flare stack 8. As the blowing progresses, the oxygen concentrations in the gas analyzed by the furnace top oxygen analyzer 21 and the furnace bottom oxygen analyzer 23 drop, and the carbon monoxide concentration in the gas analyzed by the furnace top CO analyzer 22 rises. Then, when the analyzed gas components have established the recovery conditions, the three-way valve 6 is turned to the recovery side and the recovery valve 9 is opened, thereby starting gas recovery in the gas holder 10.

Figure 2A:
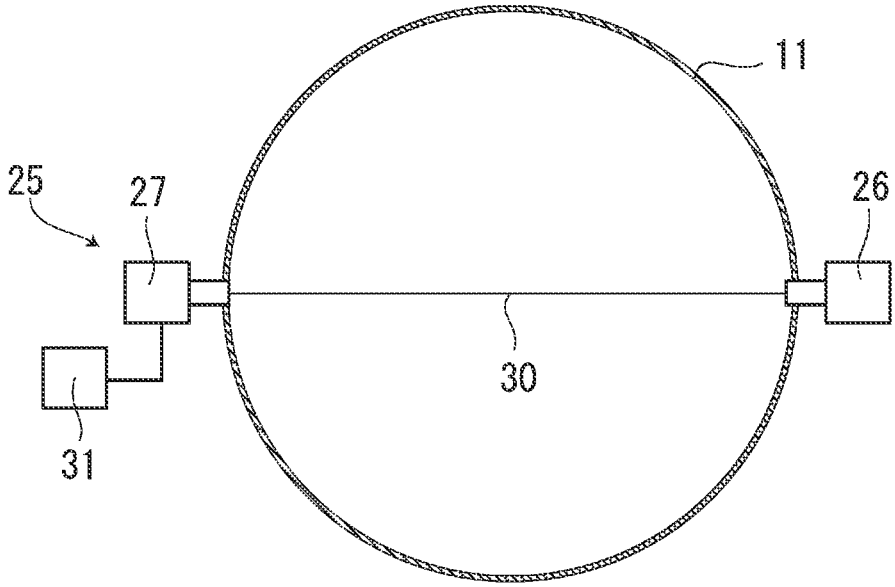
FIG. 2A is a drawing showing a situation where a laser type gas analyzer is used as a furnace bottom oxygen analyzer.

In the present embodiment, a laser type gas analyzer 25 that irradiates the exhaust gas in the flue 11 with laser light and measures gas concentration from quantity-of-light changes caused by the light absorption of the laser light is used as the furnace bottom oxygen analyzer 23. The laser type gas analyzer 25, as shown in FIG. 2A, is constituted by a laser irradiation part 26 that irradiates a measurement space with laser light 30 for measurement, a laser light receiving part 27 that detects the laser light 30 for measurement transmitted through the measurement space, and an arithmetic processing unit 31 that processes output signals of the laser light receiving part. The data of mean concentration and mean temperature of molecules or atoms that are the detection targets are obtained by irradiating the measurement space while continuously changing the wavelength of the laser light 30 emitted from the laser irradiation part 26 and by analyzing and operating the resulting output signals of the laser light receiving part 27 using the arithmetic processing unit 31.

In the converter exhaust gas recovery apparatus according to the present embodiment, the laser type gas analyzer 25 is installed as the furnace bottom oxygen analyzer 23 at the flue 11 that is the exhaust gas path on the downstream side of the wet dust collection position. In the present embodiment, as shown in FIG. 1, the laser type gas analyzer 25 is provided in the exhaust gas path on the downstream side of the induced draft fan 5. Since the exhaust gas in the flue 11 is the gas which the wet dust collection was performed, the amount of dust in the exhaust gas is significantly reduced. As shown in FIG. 2A, the laser irradiation part 26 is arranged outside the flue 11, and irradiates the exhaust gas in the flue 11 with the laser light 30 so as to be at a right angle to the centerline of the flow of the exhaust gas. The laser light receiving part 27 is arranged outside the flue 11 opposite the laser irradiation part 26. The laser type gas analyzer 25 arranged in this way can analyze the oxygen concentration of exhaust gas that flows in the flue 11.

Figure 2B:
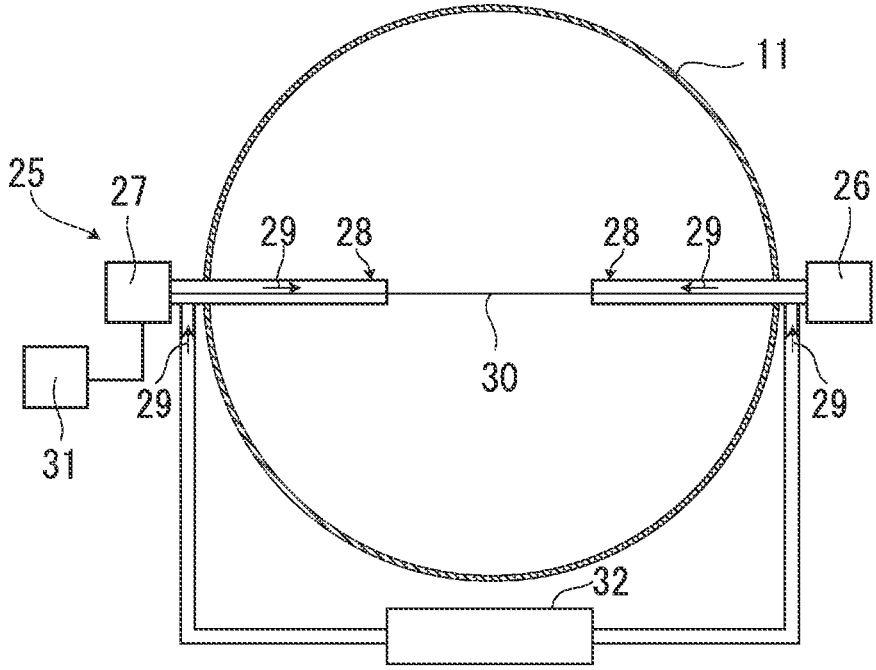
FIG. 2B is a view showing a situation in a case where a laser type gas analyzer having insertion tubes is used as the furnace bottom oxygen analyzer.

The flue 11 on the downstream side of the induced draft fan 5 of the converter exhaust gas recovery apparatus has a large diameter exceeding 2 m. The length of the optical path of the laser light 30 that leads from the laser irradiation part 26 to the laser light receiving part 27 becomes equal to or greater than the diameter of the flue 11. In the converter exhaust gas recovery apparatus according to the present embodiment, a lot of moisture is contained in the exhaust gas because the wet dust collection is performed in the venturi scrubber (dust collection position) 4. Additionally, since the temperature of the exhaust gas usually drops to 100° C. or lower in the flue 11, dew condensation or the like tends to occur. If the optical path of the laser light 30 is too long in a case where a lot of dust or waterdrops are present in the exhaust gas, the laser light 30 may be scattered in the dust or waterdrops, and measurement may become difficult. In such a case, as shown in FIG. 2B, it is desirable to arrange insertion tubes 28 that protrude from the laser irradiation part 26 side and the laser light receiving part 27 side so as to surround the periphery of the optical path of the laser light 30 and are open at tips thereof. Additionally, it is desirable to cause nitrogen gas to flow into the insertion tubes 28 from nitrogen gas supply device 32 as purge gas 29 so as to flow toward insertion tube tips inside the furnace. Thereby, the insides of the insertion tubes are always filled with pure nitrogen gas. That is, an optical path along which measurement gas flows in the optical path for the laser light 30 becomes the interval between a tip and another tip in the insertion tubes 28 that extend from both sides, that is, the interval between the tips of the insertion tubes. Accordingly, the optical path length of the laser light 30 that passes through the measurement gas can be shortened by virtue of the installation of the insertion tubes 28. As a result, even if dust or waterdrops are contained in the exhaust gas, scattering of the laser light 30 can be reduced and it is possible to analyze the oxygen-in-gas concentration with high accuracy.

Moreover, even if dust or waterdrops are contained in the exhaust gas, it is desirable to set the transmissivity of the laser light 30 to 10% or higher in order to more reliably analyze the oxygen-in-gas concentration. Here, the transmissivity represents the ratio of the light quantity of the laser light, having a wavelength other than the absorption wavelength of oxygen, which is received by the laser light receiving part, to the light quantity of the laser light radiated from the laser irradiation part.

Additionally the present inventors have revealed that the transmissivity of laser light, the optical path length of laser light that passes through the exhaust gas, and the flow velocity of the exhaust gas have the correlation as in the following Expression 1, in the converter exhaust gas recovery apparatus according to the present embodiment. That is, a predetermined transmissivity can be easily obtained by adjusting the optical path length of laser light that passes through the exhaust gas, that is, the interval between tip and another tip in the insertion tubes 28 that extend from both sides, according to the flow velocity of the exhaust gas.

$$X=\alpha\times\exp(-L\times\beta\times v)\times 100 \qquad \text{Expression 1}$$

Here, X is the transmissivity (%), L is the optical path length (m), v is the flow velocity of the exhaust gas (m/s), $\alpha$ is the damping coefficient of the laser light that does not depend on the flow velocity of the exhaust gas, and $\beta$ is a coefficient representing the absorbance of the exhaust gas with respect to the flow velocity.

In addition, in the converter exhaust gas recovery apparatus according to the present embodiment, $\alpha=0.43$ and $\beta=0.0278$ are set.

In the laser type gas analyzer having the insertion tubes 28 as shown in FIG. 2B, in a case where the converter exhaust gas contains dust, waterdrops, or the like, the converter exhaust gas may enter the insides of the insertion tubes 28 from the tips of the insertion tubes 28. As a result, there is a concern that dust or waterdrops may adhere to the inner walls of the insertion tubes 28, the laser irradiation part, the laser light receiving part, or the like, and analysis accuracy may be reduced. Therefore, there is a concern that the frequency of maintenance may be increased and productivity may be lowered.

Figures 3A, 3B, 3C:
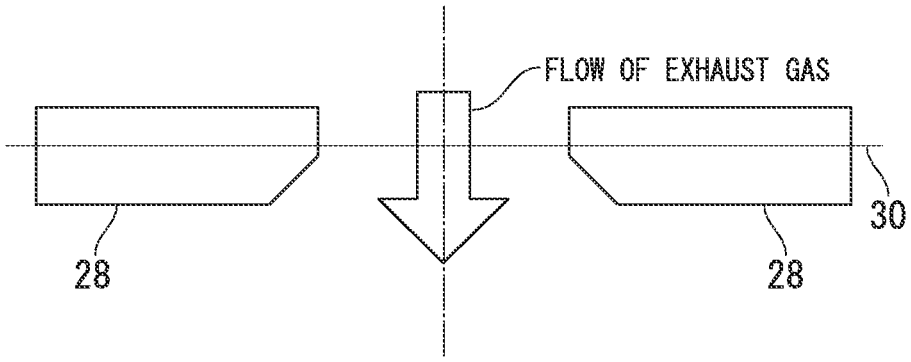
FIG. 3A is a view showing an example of the tip shape of the insertion tubes and is a view when the insertion tubes are viewed from the side.
FIG. 3B is a view showing an example of the tip shape of the insertion tubes and is a view as viewed from the opening surface side of the insertion tubes.
FIG. 3C is a schematic view showing the relationship between the cutouts of the insertion tubes and the flow direction of exhaust gas.

The present inventors have revealed that entry of the converter exhaust gas into the insertion tubes 28 can be suppressed by changing the shape of opening surfaces of the tips of the insertion tubes 28. Specifically, it turned out that it is desirable that the insertion tubes have cutouts on the downstream side in the flow direction of the exhaust gas as shown in FIG. 3C when viewed by the line of sight perpendicular to a virtual plane including the centerline of the flow of the exhaust gas and the optical axis of the laser light. This is because the amount of converter exhaust gas that collides with the inner walls of the insertion tubes is reduced by having the cutouts on the downstream side.

Moreover, it turned out that it is more desirable that, when viewed from the above line of sight, the cutouts be formed by inclined surfaces that have an inclination of 45° to 75° with respect to the centerline of the flow of the exhaust gas and the length of the inclined surfaces in a direction along the centerline of the flow of the exhaust gas be ⅓ to ⅔ of the outside dimension of the insertion tubes. Since the amount of converter exhaust gas colliding with the inner walls does not decrease if the above-described inclination is less than 45° and the cutout area is large and the inflow amount of the converter exhaust gas increases if the inclination is more than 75°, these are not desirable. Additionally, since the cutout area is large and the inflow amount of the converter exhaust gas increases if the above-described length is more than ⅔ of the outside dimension of the insertion tubes, this is not desirable. On the other hand, the amount of converter exhaust gas colliding with the inner walls does not decrease if the length is less than ⅓ of the outside dimension of the insertion tubes.

In the present embodiment, the same analyzers as the related art are used as the furnace top oxygen analyzer 21 and the furnace top CO analyzer 22. This is because, in the related art, the response delay of gas analysis is conspicuous at the furnace bottom oxygen analyzer 23, and the recovery start timing of the converter exhaust gas (exhaust gas) can be advanced and the effect of an increase in gas recovery amount can be obtained by changing the furnace bottom oxygen analyzer 23 from a paramagnetic oxygen analyzer to the laser type gas analyzer 25. In addition, even if laser type gas analyzers are used as the furnace top oxygen analyzer 21 and the furnace top CO analyzer 22, the effects in the present embodiment are not impaired.

In the converter exhaust gas recovery method according to the present embodiment, the converter exhaust gas recovery apparatus according to the above present embodiment is used, the generated converter exhaust gas is diffused to the atmosphere when converter blowing is started, and the gas is switched to recovery from the atmosphere diffusion to the gas holder 10 when the oxygen-in-gas concentrations measured by the laser type gas analyzers 25 used as the furnace top oxygen analyzer 21 and the furnace bottom oxygen analyzer 23 become a predetermined concentration or lower and when the CO-in-gas concentration measured by the furnace top CO analyzer 22 becomes a predetermined concentration or higher. Since the laser type gas analyzer 25 is used as the furnace bottom oxygen analyzer 23, the recovery start timing of the converter exhaust gas can be advanced, and the gas recovery amount can be increased.

Although the OG system converter exhaust gas recovery apparatus has been described above as an example, the above aspect may be carried out by other systems in a case where downstream oxygen concentration is a recovery condition in a non-combustion type gas recovery apparatus.

EXAMPLES

Example 1

The present invention was applied in an OG system converter exhaust gas recovery apparatus of a 300 t converter. The overall OG system converter exhaust gas recovery apparatus is as shown in FIG. 1.

The furnace top oxygen analyzer 21 and the furnace top CO analyzer 22 were installed on the exhaust gas path of the radiation section 3 at the top of the converter, and the furnace bottom oxygen analyzer 23 was installed at the flue 11 on the downstream side of the wet dust collection position. At the time of the start of blowing, the exhaust gas from the flue 11 was discharged to the flare stack 8 by the operation of the three-way valve 6 after the recovery valve 9 was closed. After the start of the blowing, when the conditions that the carbon monoxide concentration measured by the furnace top CO analyzer 22 became 25% or higher and the oxygen concentrations in the exhaust gas at two places measured by the furnace top oxygen analyzer 21 and the furnace bottom oxygen analyzer 23 became 2% or lower were established, for the first time, the recovery valve 9 was opened, and the exhaust gas path was switched by the operation of the three-way valve 6 to start the recovery of the exhaust gas to the gas holder 10.

In the example of the related art, magnetic type analyzers were used for the furnace top oxygen analyzer 21 and furnace bottom oxygen analyzer 23 and an infrared type analyzer was used for the furnace top CO analyzer 22.

The example of the present invention is different from the example of the related art in that the laser type gas analyzer 25 is used as the furnace bottom oxygen analyzer 23. As shown in FIG. 2B, the laser type gas analyzer 25 was installed at the flue 11 on the downstream side of the induced draft fan 5. The laser irradiation part 26 was arranged outside the flue 11, the laser light 30 was radiated toward the exhaust gas within the flue 11, and the laser light receiving part 27 was arranged outside the flue 11 opposite the laser irradiation part 26. The oxygen concentration in the exhaust gas that passes through the flue 11 was analyzed by irradiating the measurement space with the laser light 30 for measurement while continuously changing the wavelength of the laser light 30 emitted from the laser irradiation part 26 and by analyzing and operating the resulting output signals of the laser light receiving part 27 using the arithmetic processing unit 31. Since the flue 11 has large a diameter of 2.4 m, as shown in FIG. 2B, the insertion tubes 28 were provided. Nitrogen gas was caused to flow into the insertion tubes 28 as the purge gas 29 so as to flow toward insertion tube tips inside the furnace. Additionally, the interval between a tip and another tip in the insertion tubes 28 that extend from both sides was 1 m. Thereby, the length of the optical path of the laser light 30 that passes through the exhaust gas was 1 m, and even if the exhaust gas contains dust or moisture, the oxygen concentration in the exhaust gas can be analyzed without problem. In addition, the tip of the insertion tube 28 was formed in a shape like patterns b shown in FIGS. 3A and 3B in both the example of the related art and the example of the present invention.

Figure 4:
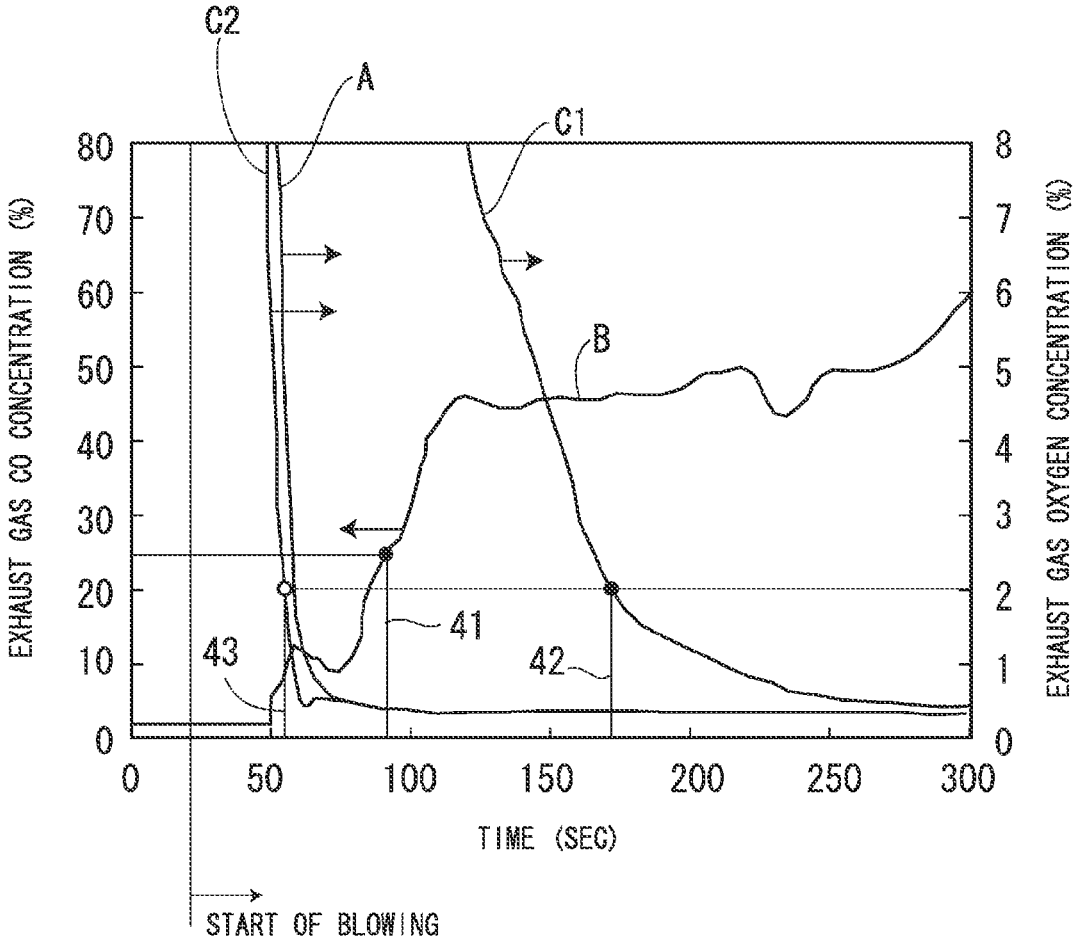
FIG. 4 is a view showing a time course of analysis results of the gas analyzer after the start of converter blowing.

FIG. 4 shows the passage of time after the blowing in the converter 1 is started, and the time courses of gas analysis results A using the furnace top oxygen analyzer 21, gas analysis results B using the furnace top CO analyzer 22, gas analysis results C1 using the furnace bottom oxygen analyzer 23 of the example of the related art, and gas analysis results C2 using the furnace bottom oxygen analyzer 23 of the example of the present invention. In the drawing, 41 represents the timing of furnace top CO analyzer conditions being established, 42 represents the timing of furnace bottom oxygen analyzer conditions being established in the method of the related art, and 43 represents the timing of the furnace bottom oxygen analyzer conditions being established in the method of the present invention.

On the horizontal axis of FIG. 4, blowing is started in about 20 seconds.

In the example of the related art, first, the conditions of the furnace top oxygen analyzer (exhaust gas oxygen concentration is 2% or lower) are established, secondly, the conditions of the furnace top CO analyzer (exhaust gas CO concentration is 25% or higher) are established in about 90 seconds (timing of 41 in the drawing), and then the conditions of the furnace bottom oxygen analyzer (exhaust gas oxygen concentration is 2% or lower) are established in about 170 seconds (timing of 42 in the drawing). At this time, the "recovery condition is established", and a sequence toward gas recovery is started.

In the example of the present invention, first, the conditions of the furnace bottom oxygen analyzer (exhaust gas oxygen concentration is 2% or less) are established in about 60 seconds approximately simultaneously with the conditions of the furnace top oxygen analyzer being established (timing of 43 in the drawing), and then the conditions of the furnace top CO analyzer are established in about 90 seconds (timing of 41 in the drawing). At this time, the "recovery condition is established", and a sequence toward gas recovery is started. Accordingly, as compared to the example of the related art, in the example of the present invention, the recovery conditions establishment became 90 seconds from 170 seconds, and the time shortening of the difference of 80 seconds could be realized.

Example 2

In the converter exhaust gas recovery apparatus of Example 1, a case where the shapes of the tips of the insertion tubes were changed as patterns a to d shown in FIGS. 3A and 3B was evaluated. The evaluation criteria were as follows. Additionally, as shown in FIG. 3C, all the insertion tubes were installed so that cutouts were located on the downstream side of the flow of gas.

In addition, the cutouts of Patterns a and d were triangular, and the angle of the cutout surfaces to the centerline of the flow of the exhaust gas was 67.5° when viewed by the line of sight perpendicular to a virtual plane including the centerline of the flow of the exhaust gas and the optical axis of the laser light. Additionally, the length of the cutout of Pattern a in the direction along the centerline of the flow of the exhaust gas was ½ of the outside dimension of the insertion tubes. Additionally, the length of the cutout of Pattern d in the direction along the centerline of the flow of the exhaust gas was equal to the outside dimension of the insertion tubes. On the other hand, the cutout of Pattern c was rectangular in plan view as described above, the length of the cutout in the direction along the centerline of the flow of the exhaust gas was ¼ of the outside dimension of the insertion tubes, and the dimension in the direction perpendicular to the length was ⅔ of the outside dimension of the insertion tubes. In addition, Pattern b did not have any cutouts.

An Evaluation was performed by visually confirming the amount of adhesion of dust or waterdrops to the inner walls of the insertion tubes.

(Evaluation Criteria)

Excellent: Adhesion of a minute amount of dust and waterdrops

Good: Adhesion of a small amount of dust and waterdrops

Pass: Adhesion of a large amount of dust and waterdrops

The results are shown in Table 1. It was found that the amount of adhesion of dust to the inner walls of the insertion tubes could be most reduced by the shape of Pattern a being adopted.

TABLE 1

| Pattern | Evaluation |
|---|---|
| a | Excellent |
| b | Pass |
| c | Good |
| d | Good |

INDUSTRIAL APPLICABILITY

By using the converter exhaust gas recovery apparatus or the converter exhaust gas recovery method of the present invention, the response delay of analysis of oxygen in gas can be reduced and the amount of recovery of the converter exhaust gas can be increased, in the converter exhaust gas recovery of collecting dust from the exhaust gas generated in the converter and recovering combustible gas in a non-combustion state.

REFERENCE SIGNS LIST

1: CONVERTER
2: HOOD
3: RADIATION SECTION
4: VENTURI SCRUBBER
5: INDUCED DRAFT FAN
6: THREE-WAY VALVE
7: BYPASS VALVE
8: FLARE STACK
9: RECOVERY VALVE
10: GAS HOLDER
11: FLUE
21: FURNACE TOP OXYGEN ANALYZER
22: FURNACE TOP CO ANALYZER
23: FURNACE BOTTOM OXYGEN ANALYZER
25: LASER TYPE GAS ANALYZER
26: LASER IRRADIATION PART
27: LASER LIGHT RECEIVING PART
28: INSERTION TUBE
29: PURGE GAS
30: LASER LIGHT
31: ARITHMETIC PROCESSING UNIT
32: NITROGEN GAS SUPPLY DEVICE
41: TIMING AT WHICH CONDITIONS OF FURNACE TOP CO ANALYZER ARE ESTABLISHED
42: TIMING AT WHICH CONDITIONS OF FURNACE BOTTOM OXYGEN ANALYZER IN THE METHOD OF THE RELATED ART ARE ESTABLISHED
43: TIMING AT WHICH CONDITIONS OF FURNACE BOTTOM OXYGEN ANALYZER IN THE METHOD OF THE PRESENT INVENTION ARE ESTABLISHED

The invention claimed is:

1. A converter exhaust gas recovery apparatus that performs a dust collection while causing an exhaust gas generated in a converter to flow to an exhaust gas path and recovers a combustible gas in a non-combustion state, the apparatus comprising:

a furnace top oxygen analyzer that analyzes an oxygen concentration in the exhaust gas on the exhaust gas path and on an upstream side of a dust collection position where the dust collection is performed, and a furnace top CO analyzer that analyzes a CO concentration in the exhaust gas; and a furnace bottom oxygen analyzer that irradiates the exhaust gas that flows on a downstream side of the dust collection position with a laser light and analyzes the oxygen concentration based on quantity-of-light changes caused by a light absorption of the laser light.

2. A converter exhaust gas recovery method performed using the converter exhaust gas recovery apparatus according to claim 1, the method comprising:

diffusing a generated exhaust gas to an atmosphere when converter blowing is started; and recovering the exhaust gas when both an oxygen concentration analyzed by the furnace top oxygen analyzer and an oxygen concentration analyzed by the furnace bottom oxygen analyzer are a predetermined concentration or lower and a CO concentration analyzed by the furnace top CO analyzer is a predetermined concentration or higher.

3. The converter exhaust gas recovery apparatus according to claim 1, wherein the furnace bottom oxygen analyzer includes:

a laser irradiation part that radiates the laser light so as to be at a right angle to a centerline of a flow of the exhaust gas;

a laser light receiving part that receives the laser light after having passed through the exhaust gas;

a first insertion tube that protrudes from the laser irradiation part toward an inside of the exhaust gas path so as to surround the periphery of an optical path of the laser light and is open at a tip thereof;

a second insertion tube that protrudes from the laser light receiving part toward the inside of the exhaust gas path so as to surround the periphery of the optical path of the laser light and is open at a tip thereof; and nitrogen gas supply device that supplies nitrogen gas to an inside of the first insertion tube and an inside of the second insertion tube.

4. A converter exhaust gas recovery method performed using the converter exhaust gas recovery apparatus according to claim 3, the method comprising:

diffusing a generated exhaust gas to an atmosphere when converter blowing is started; and recovering the exhaust gas when both an oxygen concentration analyzed by the furnace top oxygen analyzer and an oxygen concentration analyzed by the furnace bottom oxygen analyzer are a predetermined concentration or lower and a CO concentration analyzed by the furnace top CO analyzer is a predetermined concentration or higher.

5. The converter exhaust gas recovery apparatus according to claim 3, wherein cutouts are formed on the downstream sides of both the tip of the first insertion tube and the tip of the second insertion tube in a flow direction of the exhaust gas when viewed by the line of sight perpendicular to a virtual plane including the centerline of the flow of the exhaust gas and an optical axis of the laser light.

6. The converter exhaust gas recovery apparatus according to claim 5, wherein when the cutouts are viewed by the line of sight, the cutouts are formed by inclined surfaces that have an inclination of 45° to 75° with respect to the centerline of the flow of the exhaust gas, and wherein a length of the inclined surfaces in a direction along the centerline of the flow of the exhaust gas is ⅓ to ⅔ of an outside dimension of the insertion tubes.

7. The converter exhaust gas recovery apparatus according to claim 3, wherein a transmissivity of the laser light, which is represented by a ratio of a light quantity of the laser light, having a wavelength other than an absorption wavelength of oxygen, which is received by the laser light receiving part, to the light quantity of the laser light radiated from the laser irradiation part, is 10% or higher.

8. A converter exhaust gas recovery method performed using the converter exhaust gas recovery apparatus according to claim 7, the method comprising:

diffusing a generated exhaust gas to an atmosphere when converter blowing is started; and recovering the exhaust gas when both an oxygen concentration analyzed by the furnace top oxygen analyzer and an oxygen concentration analyzed by the furnace bottom oxygen analyzer are a predetermined concentration or lower and a CO concentration analyzed by the furnace top CO analyzer is a predetermined concentration or higher.

9. The converter exhaust gas recovery apparatus according to claim 7, wherein cutouts are formed on the downstream sides of both the tip of the first insertion tube and the tip of the second insertion tube in a flow direction of the exhaust gas when viewed by the line of sight perpendicular to a virtual plane including the centerline of the flow of the exhaust gas and an optical axis of the laser light.

10. The converter exhaust gas recovery apparatus according to claim 9, wherein when the cutouts are viewed by the line of sight, the cutouts are formed by inclined surfaces that have an inclination of 45° to 75° with respect to the centerline of the flow of the exhaust gas, and wherein a length of the inclined surfaces in a direction along the centerline of the flow of the exhaust gas is ⅓ to ⅔ of an outside dimension of the insertion tubes.

11. The converter exhaust gas recovery apparatus according to claim 7, wherein a relationship between an interval between the tip of the first insertion tube and the tip of the second insertion tube and the transmissivity satisfies a following Expression 1, $$X=\alpha\times\exp(-L\times\beta\times v)\times 100 \qquad \text{Expression 1}$$

wherein X is the transmissivity as a percentage, L is the interval in units of m, v is a flow velocity of the exhaust gas and in units of m/s, α is a damping coefficient of the laser light, and β is a coefficient representing an absorbance of the exhaust gas.

12. A converter exhaust gas recovery method performed using the converter exhaust gas recovery apparatus according to claim 11, the method comprising:

diffusing a generated exhaust gas to an atmosphere when converter blowing is started; and recovering the exhaust gas when both an oxygen concentration analyzed by the furnace top oxygen analyzer and an oxygen concentration analyzed by the furnace bottom oxygen analyzer are a predetermined concentration or lower and a CO concentration analyzed by the furnace top CO analyzer is a predetermined concentration or higher.

13. The converter exhaust gas recovery apparatus according to claim 11, wherein cutouts are formed on the downstream sides of both the tip of the first insertion tube and the tip of the second insertion tube in a flow direction of the exhaust gas when viewed by the line of sight perpendicular to a virtual plane including the centerline of the flow of the exhaust gas and an optical axis of the laser light.

14. The converter exhaust gas recovery apparatus according to claim 13, wherein when the cutouts are viewed by the line of sight, the cutouts are formed by inclined surfaces that have an inclination of 45° to 75° with respect to the centerline of the flow of the exhaust gas, and wherein a length of the inclined surfaces in a direction along the centerline of the flow of the exhaust gas is ⅓ to ⅔ of an outside dimension of the insertion tubes.

* * * * *